US005998940A

United States Patent [19]

Takahashi et al.

[11] Patent Number: 5,998,940

[45] Date of Patent: Dec. 7, 1999

[54] HIGH-PRESSURE DISCHARGE LAMP WITH REDUCED BAD INFLUENCE BY ACOUSTICAL STANDING WAVE

[75] Inventors: Kiyoshi Takahashi, Osaka; Makoto Horiuchi, Sakurai; Mamoru Takeda, Kyoto, all of Japan

[73] Assignee: Matsushita Electric Industrial Co., Ltd., Japan

[21] Appl. No.: 09/157,593

[22] Filed: Sep. 21, 1998

[51] Int. Cl.[6] ..... H01J 61/30

[52] U.S. Cl. ..... 315/246; 315/248; 313/634; 313/493

[58] Field of Search ..... 315/248, 246; 313/634, 493, 642, 641

[56] References Cited

U.S. PATENT DOCUMENTS

| | | | |
|---|---|---|---|
| 4,170,746 | 10/1979 | Davenport | 315/246 |
| 4,237,400 | 12/1980 | Wesselink et al. | 313/204 |
| 4,983,889 | 1/1991 | Roberts | 315/246 |
| 5,416,383 | 5/1995 | Genz | 313/634 |
| 5,436,533 | 7/1995 | Fromm et al. | 315/246 |
| 5,672,932 | 9/1997 | Goldman | 313/493 |

FOREIGN PATENT DOCUMENTS

| | | |
|---|---|---|
| 61-126757 | 6/1986 | Japan . |
| 4-67742 | 10/1992 | Japan . |
| 5-57693 | 8/1993 | Japan . |

*Primary Examiner*—Hoanganh Le
*Assistant Examiner*—Wilson Lee
*Attorney, Agent, or Firm*—Parkhurst & Wendel, L.L.P.

[57] ABSTRACT

A high-pressure discharge lamp includes an arc tube. The arc tube is supplied with electric power having a frequency at which substantially only one sound standing wave occurs in the arc tube. The sound standing wave is of a given mode, and is in a radial direction with respect to the arc tube. The given mode corresponds to, for example, a first-order mode. Preferably, the arc tube satisfies a relation as follows:

$$(n+0.2) \leqq 2L/D \leqq (n+0.8)$$

where "n" denotes a natural number, and "L" denotes an axial length of an interior of the arc tube and "D" denotes an inside diameter of the arc tube.

9 Claims, 6 Drawing Sheets

HIGH-PRESSURE DISCHARGE LAMP WITH REDUCED BAD INFLUENCE BY ACOUSTICAL STANDING WAVE

BACKGROUND OF THE INVENTION

1. Field of the Invention

This invention relates to a high-pressure discharge lamp which can be used as a light source in various apparatuses such as a liquid-crystal projector, an illuminator, or a lighting equipment.

2. Description of the Related Art

In a prior-art high-pressure discharge lamp, an arc tends to flicker or fall into disorder when the lamp is operated by electric power having a frequency in the range of 10 to 200 kHz. In a worst case, the arc goes out.

A conceivable cause of that phenomenon is as follows. Some mechanisms in the discharge lamp convert the electric power into acoustic energy (sound energy) having a frequency equal to the frequency of the electric power. Acoustic resonance occurs in the discharge lamp. During the presence of the resonance, an acoustic standing wave (a sound standing wave) is developed in the discharge lamp. The acoustic standing wave makes the arc unstable.

Japanese published unexamined patent application 61-126757 discloses a high-pressure discharge lamp in which soft members made of quartz wool are provided on the inner surfaces of ends of an arc tube. The soft members absorb sound waves, thereby controlling the growing up of a resonant sound wave. Accordingly, an arc in the arc tube is stable in a wide frequency band related to electric power fed to the arc tube.

It is known to operate a high-pressure discharge lamp by rectangular electric wave having a frequency in the range of 100 to 300 Hz. Such low-frequency operation of the discharge lamp provides a stable arc.

In the case where a high-pressure discharge lamp is operated horizontally by low-frequency rectangular electric wave, an arc in the discharge lamp bends or curves upwards. Thus, in this case, the temperature of a top portion of the discharge lamp tends to locally rise. Such a temperature rise causes devitrification in the discharge lamp at an early stage, and hence shortens the life of the discharge lamp.

When a high-pressure discharge lamp having an upwardly curving arc is used in combination with an optical system such as a reflecting mirror, the asymmetry of the arc shape causes the illuminance at an illuminated surface to significantly vary from position to position.

SUMMARY OF THE INVENTION

It is a first object of this invention to provide a high-pressure discharge lamp which develops a stable arc.

It is a second object of this invention to provide a high-pressure discharge lamp which prevents an arc from curving.

It is a third object of this invention to provide a high-pressure discharge lamp for use in combination with an optical system which provides only a small position-dependent variation in luminance at an illuminated surface.

A first aspect of this invention provides a high-pressure discharge lamp comprising an arc tube; and means for operating the arc tube with electric power having a frequency at which substantially only one sound standing wave occurs in the arc tube, the sound standing wave being of a given mode and being in a radial direction with respect to the arc tube.

A second aspect of this invention is based on the first aspect thereof, and provides a high-pressure discharge lamp wherein the given mode corresponds to a first-order mode.

A third aspect of this invention is based on the first aspect thereof, and provides a high-pressure discharge lamp wherein the arc tube satisfies a relation as follows:

$$(n+0.2) \leqq 2L/D \leqq (n+0.8)$$

where "n" denotes a natural number, and "L" denotes an axial length of an interior of the arc tube and "D" denotes an inside diameter of the arc tube.

A fourth aspect of this invention is based on the first aspect thereof, and provides a high-pressure discharge lamp wherein an interior of the arc tube has a cylindrical shape.

A fifth aspect of this invention is based on the first aspect thereof, and provides a high-pressure discharge lamp wherein an interior of the arc tube has a circular shape in cross section.

A sixth aspect of this invention is based on the first aspect thereof, and provides a high-pressure discharge lamp wherein an end of the arc tube has one of a wedge shape and an inwardly-projecting shape.

A seventh aspect of this invention provides a high-pressure discharge lamp comprising an arc tube having an end, wherein inner surfaces of the end are of a wedge-shaped configuration.

An eighth aspect of this invention provides a high-pressure discharge lamp comprising an arc tube having an end, wherein walls of the end inwardly project toward a center of an interior of the arc tube.

A ninth aspect of this invention provides a high-pressure discharge lamp comprising an arc tube which satisfies a relation as follows:

$$(n+0.2) \leqq 2L/D \leqq (n+0.8)$$

where "n" denotes a natural number, and "L" denotes an axial length of an interior of the arc tube and "D" denotes an inside diameter of the arc tube.

DESCRIPTION OF THE PREFERRED EMBODIMENTS

First Embodiment

Figure 1:
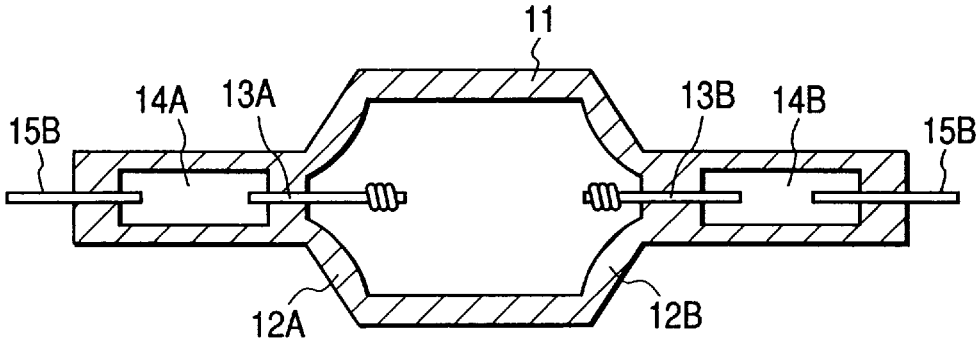
FIG. 1 is a diagrammatic section view of a high-pressure discharge lamp according to a first embodiment of this invention.

FIG. 1 shows a high-pressure discharge lamp according to a first embodiment of this invention. The high-pressure discharge lamp of FIG. 1 includes an arc tube 11 having walls made of quartz. Opposite ends 12A and 12B of the arc tube 11 contain electrodes 13A and 13B, respectively.

The electrode 13A includes a rod made of tungsten and having a diameter of 0.65 mm. The rod extends from an interior of the tube end 12A into the walls of the tube end 12A. The electrode 13A also includes five turns of a tungsten wire around an end portion of the rod which is located in the interior of the tube end 12A. The tungsten wire has a diameter of 0.25 mm. The electrode 13A is airtightly supported by the walls of the tube end 12A.

Similarly, the electrode 13B includes a rod made of tungsten and having a diameter of 0.65 mm. The rod extends from an interior of the tube end 12B into the walls of the tube end 12B. The electrode 13B also includes five turns of a tungsten wire around an end portion of the rod which is located in the interior of the tube end 12B. The tungsten wire has a diameter of 0.25 mm. The electrode 13B is airtightly supported by the walls of the tube end 12B.

The rod of the electrode 13A is connected to a molybdenum foil member 14A extending in the walls of the tube end 12A. A lead wire 15A connected to the molybdenum foil member 14A projects outward from the walls of the arc tube 11.

Similarly, the rod of the electrode 13B is connected to a molybdenum foil member 14B extending in the walls of the tube end 12B. A lead wire 15B connected to the molybdenum foil member 14B projects outward from the walls of the arc tube 11.

The arc tube 11 has a cylindrical shape. The outside diameter of the arc tube 11 is equal to 10 mm. The volume of the interior of the arc tube 11 is equal to 1.5 cc. The ends 12A and 12B of the arc tube 11 have wedge-shaped structures. Specifically, the walls of each of the ends 12A and 12B have two slightly convex inner surfaces which are arranged in a V configuration in section, and which are oblique with respect to the axial direction of the arc tube 11. The walls of each of the ends 12A and 12B have a V-shaped recess exposed at the interior of the arc tube 11. The tips or the operative ends of the electrodes 13A and 13B are on the axis of the arc tube 11 so that an arc will be developed along the axis of the arc tube 11.

Argon gas is placed in the arc tube 11. The amount of argon gas in the arc tube 11 corresponds to a pressure of 100 Torr at a temperature of 300 K (that is, a room temperature or an ordinary temperature). Mercury being 30 mg in weight is placed in the arc tube 11. Metal halide or metal halides being 3 mg in total weight are placed in the arc tube 11.

Figure 2:
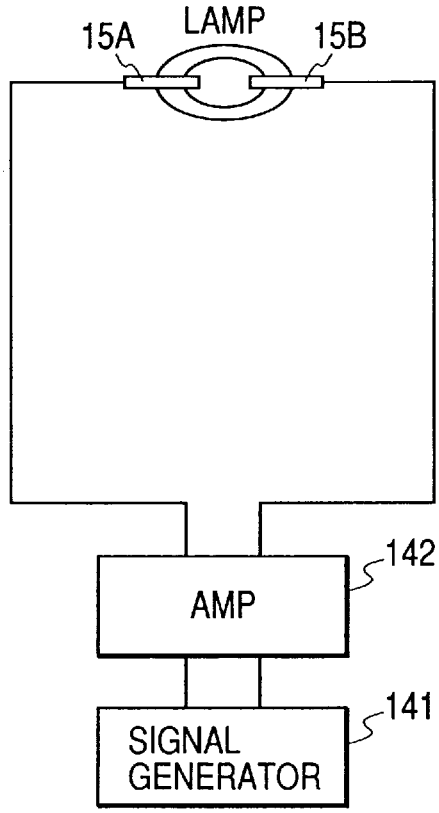
FIG. 2 is a diagram of an operation system for a high-pressure discharge lamp.

Experiments were performed on the high-pressure discharge lamp of FIG. 1. During the experiments, the high-pressure discharge lamp was operated by an operation system in FIG. 2. The operation system included a signal generator 141, and an amplifier 142 connected to the signal generator 141. The amplifier 142 was connected to the lead wires 15A and 15B of the high-pressure discharge lamp. The signal generator 141 produced and outputted an electric signal having a variable frequency and a variable waveform. The output signal of the device 141 was fed to the amplifier 142, being enlarged thereby. The amplifier 142 applied the resultant signal between the lead wires 15A and 15B of the high-pressure discharge lamp as an operation signal. Therefore, the high-pressure discharge lamp was operated.

Figure 3:
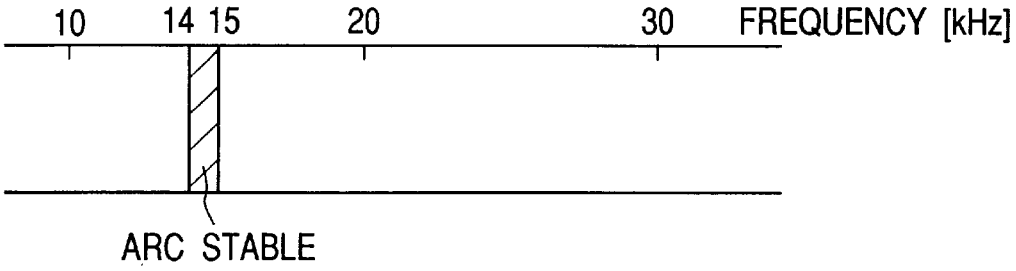
FIG. 3 is a frequency-domain diagram of the stability of an arc in the high-pressure discharge lamp of FIG. 1.

During the experiments, the frequency of the electric operation signal applied to the high-pressure discharge lamp was varied while the waveform thereof remained fixed to a sinusoidal shape. During the experiments, an arc developed in the high-pressure discharge lamp was monitored. As shown in FIG. 3, the arc was stable and did not curve at frequencies of the electric operation signal in only a single narrow band extending between 14 kHz and 15 kHz.

It is thought that the experimental results in FIG. 3 are caused by the following fact. The wedge-shaped structures of the ends 12A and 12B of the arc tube 11 do not reflect sound waves toward the center of the tube 11. Therefore, sound waves propagated in the axial direction of the tube 11 are significantly attenuated. Thus, any sound standing wave does not occur in the axial direction of the tube 11, or only a very weak sound standing wave is present in the axial direction of the tube 11. On the other hand, a strong sound standing wave is present in a radial direction of the tube 11 since the tube 11 is cylindrical. The sound standing wave in the radial direction corresponds to the single narrow frequency band of FIG. 3 in which the arc is stable.

During the experiments, radial-direction sound standing waves of a first-order mode to a tenth-order mode were successively generated in the arc tube 11, and the arc developed therein was monitored. The arc occurring in the presence of the sound standing wave of the first-order mode was the stablest among the arcs occurring in the presence of the sound standing waves of the first-order mode to the tenth-order mode respectively.

Figure 4:
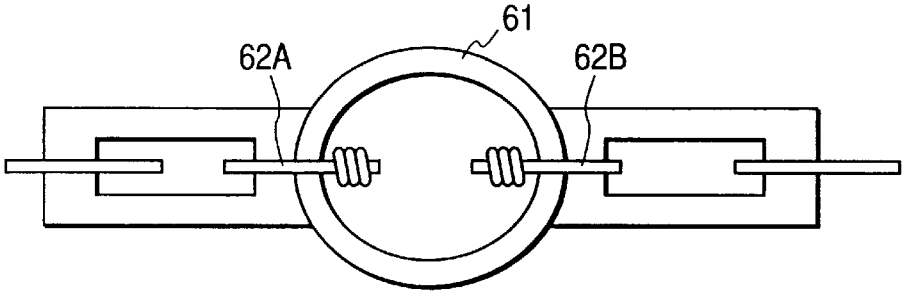
FIG. 4 PRIOR ART
FIG. 4 is a diagrammatic section view of a prior-art high-pressure discharge lamp.
Figure 5:
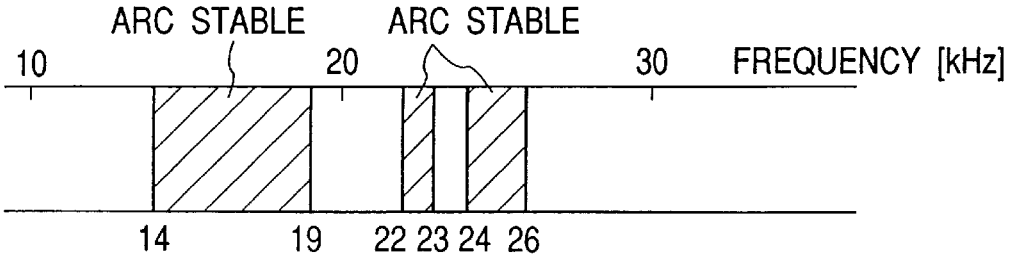
FIG. 5 PRIOR ART
FIG. 5 is a frequency-domain diagram of the stability of an arc in the prior-art high-pressure discharge lamp of FIG. 4.

FIG. 4 shows a prior-art high-pressure discharge lamp which includes an arc tube 61, and electrodes 62A and 62B provided in ends of the arc tube 61. Experiments similar to the above-mentioned experiments were performed on the prior-art high-pressure discharge lamp of FIG. 4. As shown in FIG. 5, the arc developed in the prior-art high-pressure discharge lamp of FIG. 4 was stable at frequencies of the electric operation signal in a plurality of different bands. Regarding most of these frequency bands, the arc curved or deformed. In addition, the stability of the arc varied from band to band.

In view of the results of the experiments, a conceivable cause of the unstableness of an arc in an arc tube is as follows. In the arc tube, there simultaneously occur sound standing waves of different modes in various directions including an axial direction and radial directions of the arc tube. The sound standing waves interfere with each other. The interference between the sound standing waves disturbs the arc in the arc tube. There is a variation in the degree of the unstableness of the arc. A conceivable cause of this variation is as follows. The interference between the sound standing waves depends on the number of the sound standing waves and also on the differences in strength among the sound standing waves. The dependence of the interference upon these factors provides a variation in the degree of the unstableness of the arc.

In the case where the high-pressure discharge lamp of FIG. 1 was operated by electric power having a frequency at which a sound standing wave occurred in a radial direction of the arc tube 11, the arc therein was stable. Radial-direction sound standing waves of a first-order mode to a tenth-order mode were successively generated in the arc tube 11, and the arc therein was monitored. The arc occurring in the presence of the sound standing wave of the first-order mode was the stablest among the arcs occurring in the presence of the sound standing waves of the first-order mode to the tenth-order mode respectively. The high-pressure discharge lamp of FIG. 1 continued to be operated, and the arc therein was monitored. At the moment 100-hour after the start of the operation of the discharge lamp, the arc commenced to flicker. At the moment 500-hour after the start of the operation of the discharge lamp, the arc disappeared. A conceivable cause of the disappearance of the arc is as follows. Conditions in the arc tube 11 which affect the sound standing wave therein have changed from the initial phase to another phase at which the arc is hardly stable. Accordingly, to keep the arc stable, it is preferable that only one sound standing wave occurs in the arc tube 11 along a radial direction thereof, and that the sound standing wave is of the first-order mode.

Figure 6:
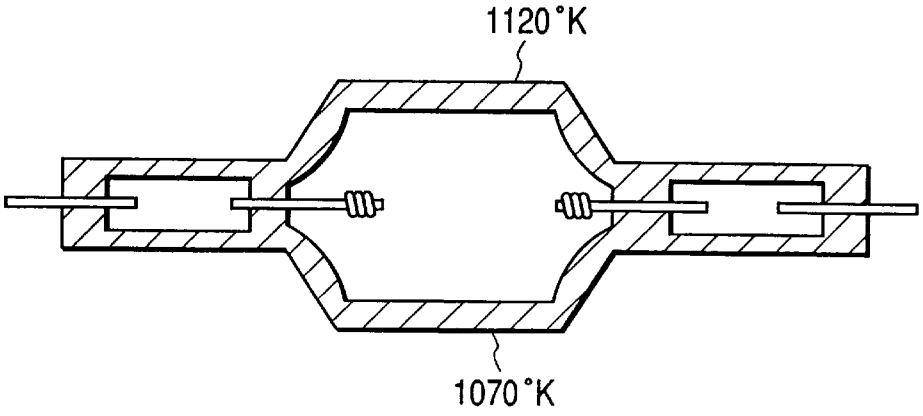
FIG. 6 is a diagrammatic section view of the high-pressure discharge lamp in FIG. 1.
Figure 7:
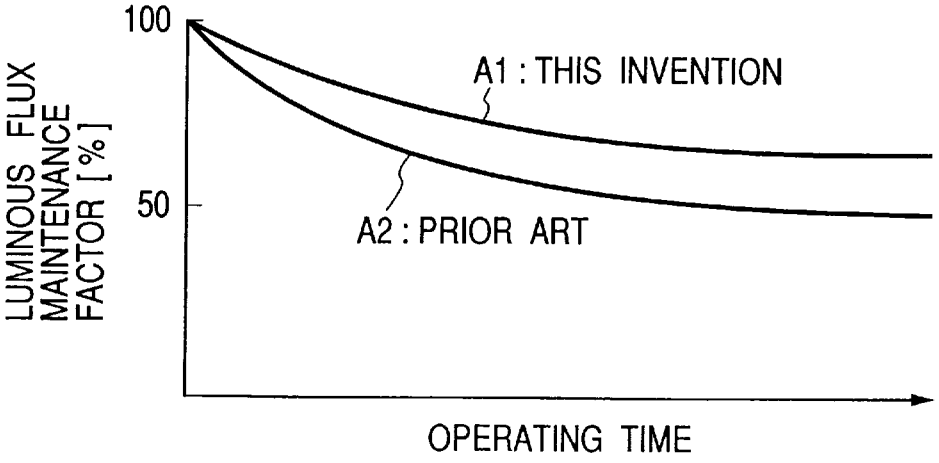
FIG. 7 is a time-domain diagram of the luminous flux maintenance factor of the high-pressure discharge lamp in FIG. 1, and the luminous flux maintenance factor of the prior-art high-pressure discharge lamp in FIG. 4.

The high-pressure discharge lamp of FIG. 1 continued to be operated by an electric sinusoidal wave having a frequency of 14.5 kHz while the arc therein was monitored and the temperatures of various positions thereon were measured. Also, the luminous flux maintenance factor (the lumen maintenance factor) of the discharge lamp was measured. The discharge lamp remained stably lighting until its life terminated. As shown in FIG. 6, a top portion of the discharge lamp reached a temperature of 1,120° K while a lower portion thereof reached a temperature of 1,070° K. As shown in FIG. 7, the luminous flux maintenance factor of the discharge lamp gradually dropped along the curve A1 in accordance with the lapse of time during which the discharge lamp remained operated.

Figure 8:
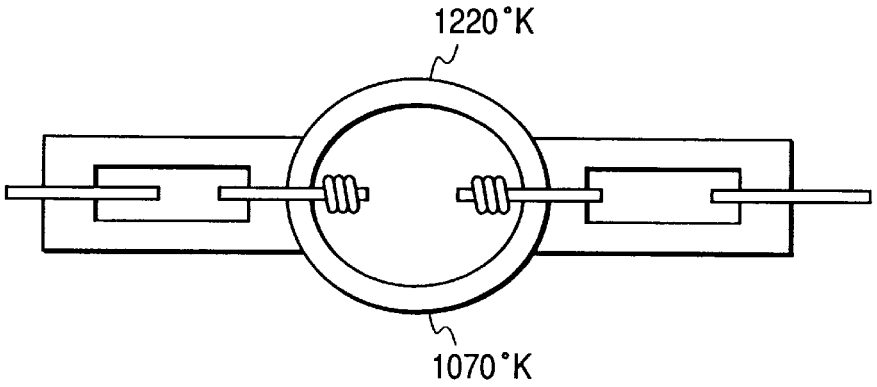
FIG. 8 PRIOR ART
FIG. 8 is a diagrammatic section view of the prior-art high-pressure discharge lamp in FIG. 4.

The prior-art high-pressure discharge lamp of FIG. 4 continued to be operated by an electric rectangular wave having a frequency of 250 Hz while the arc therein was monitored and the temperatures of various positions thereon were measured. Also, the luminous flux maintenance factor of the prior-art discharge lamp was measured. As shown in FIG. 8, a top portion of the prior-art discharge lamp reached a temperature of 1,220° K while a lower portion thereof reached a temperature of 1,070° K. As shown in FIG. 7, the luminous flux maintenance factor of the prior-art discharge lamp gradually dropped along the curve A2 in accordance with the lapse of time during which the prior-art discharge lamp remained operated.

The temperature of the top portion of the discharge lamp of FIG. 1 was lower than the temperature of the top portion of the prior-art discharge lamp by 100° K. The lower temperature was effective in preventing the occurrence of devitrification in the discharge lamp, and hence caused a longer life of the discharge lamp. As shown in FIG. 7, the discharge lamp of FIG. 1 was better than the prior-art discharge lamp in the luminous flux maintenance factor (the lumen maintenance factor).

It should be noted that the high-pressure discharge lamp of FIG. 1 may be modified into a high-pressure mercury lamp or a high-pressure sodium lamp.

The high-pressure discharge lamp of FIG. 1 may be operated by electric power having a waveform different from a sinusoidal shape.

Second Embodiment

Figure 9:
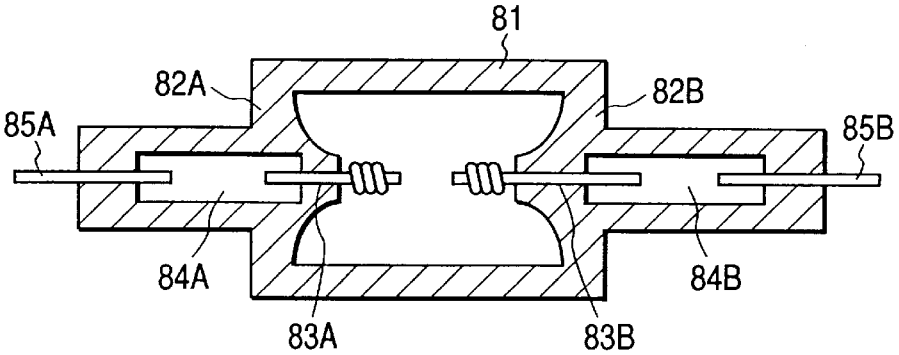
FIG. 9 is a diagrammatic section view of a high-pressure discharge lamp according to a second embodiment of this invention.

FIG. 9 shows a high-pressure discharge lamp according to a second embodiment of this invention. The high-pressure discharge lamp of FIG. 9 is similar to the high-pressure discharge lamp of FIG. 1 except for design changes indicated later.

The high-pressure discharge lamp of FIG. 9 includes an arc tube 81 having walls made of quartz. Opposite ends 82A and 82B of the arc tube 81 contain electrodes 83A and 83B, respectively.

The electrode 83A is connected to a molybdenum foil member 84A extending in the walls of the tube end 82A. A lead wire 85A connected to the molybdenum foil member 84A projects outward from the walls of the arc tube 81.

Similarly, the electrode 83B is connected to a molybdenum foil member 84B extending in the walls of the tube end 82B. A lead wire 85B connected to the molybdenum foil member 84B projects outward from the walls of the arc tube 81.

The arc tube 81 has a cylindrical shape. The walls of each of the ends 82A and 82B of the arc tube 81 have an inward projection by which the electrode 83A or 83B is airtightly supported. The inward projection at each of the ends 82A and 82B has side surfaces oblique with respect to the axial direction of the arc tube 81.

Figure 10:
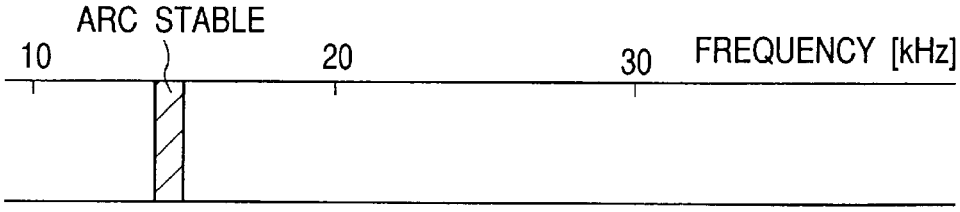
FIG. 10 is a frequency-domain diagram of the stability of an arc in the high-pressure discharge lamp of FIG. 9.

Experiments were performed on the high-pressure discharge lamp of FIG. 9. During the experiments, the high-pressure discharge lamp was operated by the operation system in FIG. 2. Specifically, the frequency of the electric operation signal applied to the high-pressure discharge lamp was varied while the waveform thereof remained fixed to a sinusoidal shape. During the experiments, an arc developed in the high-pressure discharge lamp was monitored. As shown in FIG. 10, the arc was stable and did not curve at frequencies of the electric operation signal in only a single narrow band extending around 15 kHz.

It is thought that the experimental results in FIG. 10 are caused by the following fact. The inward projections on the ends 82A and 82B of the arc tube 81 do not reflect sound waves toward the center of the tube 81. Therefore, sound waves propagated in the axial direction of the tube 81 are significantly attenuated. Thus, any sound standing wave does not occur in the axial direction of the tube 81, or only a very weak sound standing wave is present in the axial direction of the tube 81. On the other hand, a strong sound standing wave is present in a radial direction of the tube 81 since the tube 81 is cylindrical. The sound standing wave in the radial direction corresponds to the single narrow frequency band of FIG. 10 in which the arc is stable.

During the experiments, radial-direction sound standing waves of a first-order mode to a tenth-order mode were successively generated in the arc tube 81, and the arc developed therein was monitored. The arc occurring in the presence of the sound standing wave of the first-order mode was the stablest among the arcs occurring in the presence of the sound standing waves of the first-order mode to the tenth-order mode respectively.

Figure 11:
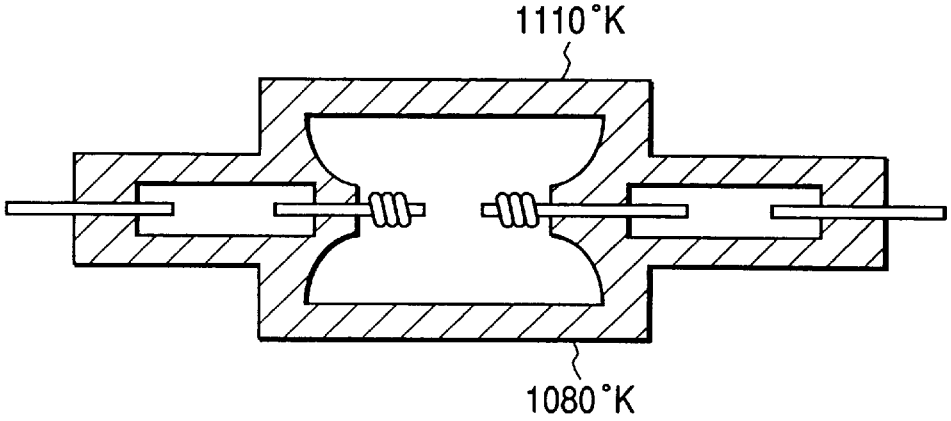
FIG. 11 is a diagrammatic section view of the high-pressure discharge lamp in FIG. 9.

The high-pressure discharge lamp of FIG. 9 continued to be operated by an electric sinusoidal wave having a frequency of 14.5 kHz while the arc therein was monitored and the temperatures of various positions thereon were measured. Also, the luminous flux maintenance factor (the lumen maintenance factor) of the discharge lamp was measured. The discharge lamp remained stably lighting until its life terminated. As shown in FIG. 11, a top portion of the discharge lamp reached a temperature of 1,110° K while a lower portion thereof reached a temperature of 1,080° K. The temperature of the top portion of the discharge lamp of FIG. 9 was lower than the temperature of the top portion of the prior-art discharge lamp of FIG. 4 by 110° K. The lower temperature was effective in preventing the occurrence of devitrification in the discharge lamp, and hence caused a longer life of the discharge lamp. The discharge lamp of FIG. 9 was better than the prior-art discharge lamp in the luminous flux maintenance factor (the lumen maintenance factor).

It should be noted that the high-pressure discharge lamp of FIG. 9 may be modified into a high-pressure mercury lamp or a high-pressure sodium lamp.

The high-pressure discharge lamp of FIG. 9 may be operated by electric power having a waveform different from a sinusoidal shape.

Third Embodiment

A third embodiment of this invention is similar to the first embodiment or the second embodiment thereof except for design changes indicated hereinafter.

Ends of an arc tube in the third embodiment use a combination of the wedge-shaped end structure in the first embodiment and the inwardly-projecting end structure in the second embodiment.

Fourth Embodiment

Figure 12:
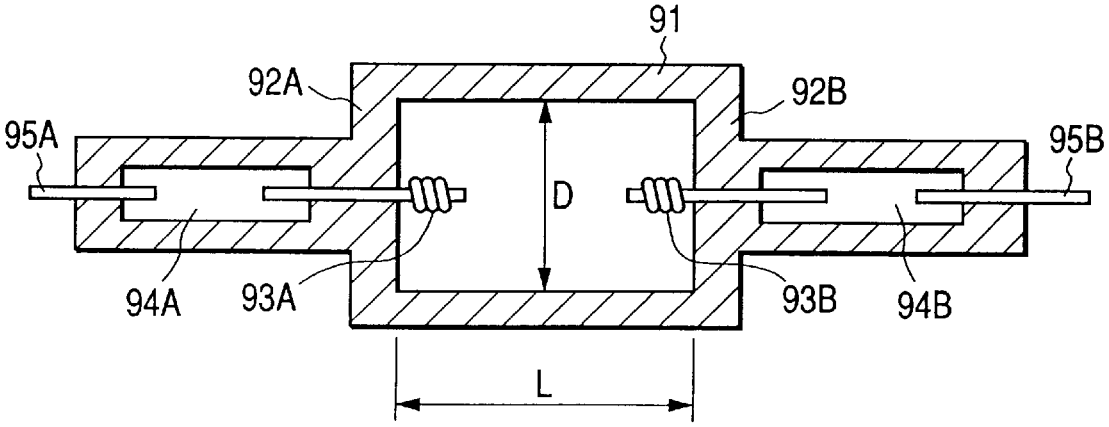
FIG. 12 is a diagrammatic section view of a high-pressure discharge lamp according to a fourth embodiment of this invention.

FIG. 12 shows a high-pressure discharge lamp according to a fourth embodiment of this invention. The high-pressure discharge lamp of FIG. 12 is similar to the high-pressure discharge lamp of FIG. 1 except for design changes indicated later.

The high-pressure discharge lamp of FIG. 12 includes an arc tube 91 having walls made of quartz. Opposite ends 92A and 92B of the arc tube 91 contain electrodes 93A and 93B, respectively.

The electrode 93A is connected to a molybdenum foil member 94A extending in the walls of the tube end 92A. A lead wire 95A connected to the molybdenum foil member 94A projects outward from the walls of the arc tube 91.

Similarly, the electrode 93B is connected to a molybdenum foil member 94B extending in the walls of the tube end 92B. A lead wire 95B connected to the molybdenum foil member 94B projects outward from the walls of the arc tube 91.

The arc tube 91 has a cylindrical shape. The walls of each of the ends 92A and 92B of the arc tube 91 have a flat inner surface perpendicular to the axis of the tube 91.

The inside axial length L of the arc tube 91, that is, the axial length of the interior of the arc tube 91, is equal to a given value. The inside diameter D of the arc tube 91 is equal to a given value. Most preferably, the given value of the inside axial length L and the given value of the inside diameter D have a predetermined relation as "2L/D=1.4".

Figure 13:
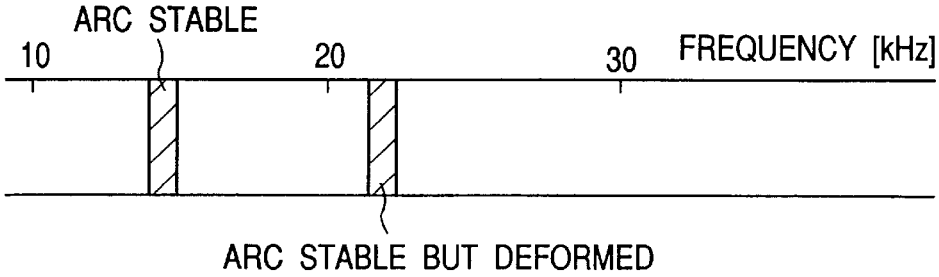
FIG. 13 is a frequency-domain diagram of the stability of an arc in the high-pressure discharge lamp of FIG. 12.
Figure 14:
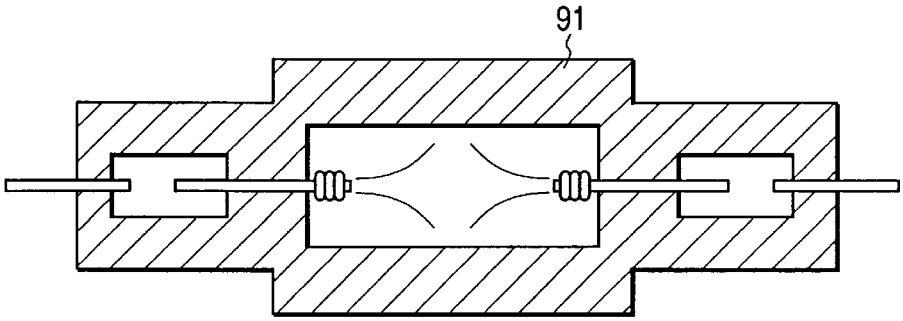
FIG. 14 is a diagrammatic section view of the high-pressure discharge lamp in FIG. 12.

Experiments were performed on the high-pressure discharge lamp of FIG. 12. During the experiments, the high-pressure discharge lamp was operated by the operation system in FIG. 2. Specifically, the frequency of the electric operation signal applied to the high-pressure discharge lamp was varied while the waveform thereof remained fixed to a sinusoidal shape. During the experiments, an arc developed in the high-pressure discharge lamp was monitored. As shown in FIG. 13, the arc was stable and did not curve at frequencies of the electric operation signal in only a single narrow band extending around 14.5 kHz. In addition, the arc was stable but curved at frequencies of the electric operation signal in only a single narrow band extending around 22 kHz. In this case, as shown in FIG. 14, the arc deformed perpendicularly to the axial direction of the arc tube 91.

It is thought that the stable-arc frequency band around 14.5 kHz corresponds to the presence of a radial-direction sound standing wave while the stable-arc frequency band around 22 kHz corresponds to the presence of an axial-direction sound standing wave. This thought is supported by the fact that the arc deforms vertically in the stable-arc frequency band around 22 kHz.

The high-pressure discharge lamp of FIG. 12 continued to be operated by an electric sinusoidal wave having a frequency of 22 kHz while the arc therein was monitored. In this case, the discharge lamp could not remain stably lighting.

The high-pressure discharge lamp of FIG. 12 continued to be operated by an electric sinusoidal wave having a frequency of 14.5 kHz while the arc therein was monitored and the temperatures of various positions thereon were measured. Also, the luminous flux maintenance factor (the lumen maintenance factor) of the discharge lamp was measured. The discharge lamp remained stably lighting until its life terminated. The temperature of the top portion of the discharge lamp of FIG. 12 was lower than the temperature of the top portion of the prior-art discharge lamp of FIG. 4. The lower temperature was effective in preventing the occurrence of devitrification in the discharge lamp, and hence caused a longer life of the discharge lamp. The discharge lamp of FIG. 12 was better than the prior-art discharge lamp in the luminous flux maintenance factor (the lumen maintenance factor).

Samples of the high-pressure discharge lamp of FIG. 12 were made. The samples were different from each other in the value "2L/D". The samples include first to thirteenth samples. Specifically, in the first sample, the value "2L/D" was equal to 1.1. In the second sample, the value "2L/D" was equal to 1.2. In the third sample, the value "2L/D" was equal to 1.6. In the fourth sample, the value "2L/D" was equal to 1.8. In the fifth sample, the value "2L/D" was equal to 1.9. In the sixth sample, the value "2L/D" was equal to 2.1. In the seventh sample, the value "2L/D" was equal to 2.2. In the eighth sample, the value "2L/D" was equal to 2.8. In the ninth sample, the value "2L/D" was equal to 2.9. In the tenth sample, the value "2L/D" was equal to 3.1. In the eleventh sample, the value "2L/D" was equal to 3.2. In the twelfth sample, the value "2L/D" was equal to 3.8. In the thirteenth sample, the value "2L/D" was equal to 3.9.

Each of the samples was operated while the arc therein was monitored. In the first sample, the arc was unstable, and its curve was great. In the second sample, the arc was stable, and its curve was small. In the third sample, the arc was stable, and its curve was small. In the fourth sample, the arc was stable, and its curve was small. In the fifth sample, the arc was unstable, and its curve was great. In the sixth sample, the arc was unstable, and its curve was great. In the seventh sample, the arc was stable, and its curve was small. In the eighth sample, the arc was stable, and its curve was small. In the ninth sample, the arc was unstable, and its curve was great. In the tenth sample, the arc was unstable, and its curve was great. In the eleventh sample, the arc was stable, and its curve was small. In the twelfth sample, the arc was stable, and its curve was small. In the thirteenth sample, the arc was unstable, and its curve was great.

These conditions are listed in Table 1 indicated below.

TABLE 1

| 2L/D | ARC STATE | ARC CURVE |
|---|---|---|
| 1.1 | UNSTABLE | GREAT |
| 1.2 | STABLE | SMALL |
| 1.6 | STABLE | SMALL |
| 1.8 | STABLE | SMALL |
| 1.9 | UNSTABLE | GREAT |
| 2.1 | UNSTABLE | GREAT |
| 2.2 | STABLE | SMALL |
| 2.8 | STABLE | SMALL |
| 2.9 | UNSTABLE | GREAT |
| 3.1 | UNSTABLE | GREAT |
| 3.2 | STABLE | SMALL |
| 3.8 | STABLE | SMALL |
| 3.9 | UNSTABLE | GREAT |

As shown in Table 1, the samples which had the values "2L/D" in the range of 1.2 to 1.8, the range of 2.2 to 2.8, and the range of 3.2 to 3.8 stably operated. Thus, the arc was stable and hardly curved in each of the lamp structures which satisfied the following relation.

$$(n+0.2) \leqq 2L/D \leqq (n+0.8) \quad (1)$$

where "n" denotes a natural number (1, 2, 3, . . . ). Accordingly, in the high-pressure discharge lamp of FIG. 12, it is preferable to choose the inside axial length L and the inside diameter D of the arc tube 91 so as to meet the previously-indicated relation (1).

In each of the samples of the high-pressure discharge lamp of FIG. 12 which meet the previously-indicated relation (1), the frequency of a radial-direction sound standing wave and the frequency of an axial-direction sound standing wave are significantly separate from each other. In each of these samples, the arc is stabilized and is prevented from considerably curving provided that the sample is operated by electric power having a frequency at which the radial-direction sound standing wave occurs therein.

It should be noted that the high-pressure discharge lamp of FIG. 12 may be modified into a high-pressure mercury lamp or a high-pressure sodium lamp.

The high-pressure discharge lamp of FIG. 12 may be operated by electric power having a waveform different from a sinusoidal shape.

What is claimed is:

1. A high-pressure discharge lamp comprising:

an arc tube; and means for operating the arc tube with electric power having a frequency at which substantially only one sound standing wave occurs in the arc tube, the sound standing wave being of a first order mode and being in a radial direction with respect to the arc tube.

2. A high-pressure discharge lamp comprising:

an arc tube: and means for operating the arc tube with electric power having a frequency at which substantially only one sound standing wave occurs in the arc tube, the sound standing wave being of a first-order mode and being in a radial direction with respect to the arc tube;

wherein the arc tube satisfies a relation as follows:

$$(n+0.2) \leqq 2L/D \leqq (n+0.8)$$

where "n" denotes a natural number, and "L" denotes an axial length of an interior of the arc tube and "D" denotes an inside diameter of the arc tube.

3. A high-pressure discharge lamp according to claim 1, wherein an interior of the arc tube has a cylindrical shape.

4. A high-pressure discharge lamp according to claim 1, wherein an interior of the arc tube has a circular shape in cross section.

5. A high-pressure discharge lamp according to claim 1, wherein an end of the arc tube has one of a wedge shape and an inwardly-projecting shape.

6. A high-pressure discharge lamp comprising an arc tube which satisfies a relation as follows:

$$(n+0.2) \leqq 2L/D \leqq (n+0.8)$$

where "n" denotes a natural number, and "L" denotes an axial length of an interior of the arc tube and "D" denotes an inside diameter of the arc tube.

7. A high-pressure discharge lamp according to claim 6, wherein the interior of the arc tube has a cylindrical shape.

8. A high-pressure discharge lamp according to claim 6, wherein the interior of the arc tube has a circular shape in cross section.

9. A high-pressure discharge lamp according to claim 6, wherein an end of the arc tube has one of a wedge shape and an inwardly-projecting shape.

* * * * *